United States Patent [19]

Retzer

[11] Patent Number: 4,884,808

[45] Date of Patent: Dec. 5, 1989

[54] GOLF CLUB WITH HEAD HAVING EXCHANGEABLE FACE PLATES

[76] Inventor: Jerome E. Retzer, 103 Forest Ridge Dr., Brevard, N.C. 28712

[21] Appl. No.: 172,389

[22] Filed: Mar. 24, 1988

[51] Int. Cl.[4] ..... A63B 53/08

[52] U.S. Cl. ..... 273/77 A; 273/79; 273/173; 273/167 J

[58] Field of Search ..... 273/77 R, 77 A, 167 R, 273/167 F, 167 H, 167 C, 167 J, 169–175, 194 R, 194 A, 194 B, 168, 78, 79

[56] References Cited

U.S. PATENT DOCUMENTS

| | | | |
|---|---|---|---|
| 1,091,231 | 3/1914 | Millar | 273/169 |
| 1,253,700 | 1/1918 | McLaughlin | 273/77 A |
| 1,349,805 | 8/1920 | Booth | 273/169 |
| 3,849,008 | 11/1974 | Boucher et al. | 403/362 |

*Primary Examiner*—Edward M. Coven
*Assistant Examiner*—S. Passaniti
*Attorney, Agent, or Firm*—Neal J. Mosely

[57] ABSTRACT

A golf club is shown with a head having a selection of exchangeable face plates adapted to be secured thereon. The club head includes a face portion, a toe portion, a heel portion. a sole or bottom portion, and a hosel receiving a shaft. The face portion has a recess exending inwardly a short distance from the outer surface of the face to receive the exchangeable face plates. A bore extends inwardly a distance from the recessed surface and a pair of smaller bores are spaced laterally to each side of the larger bore. Each face plate has a flat rear surface corresponding to the recess in the club head. The face plates are provided in varied swing weights and hardnesses and the ball striking surfaces have different characteristics for loft, bulge, and or roll. A plurality of face plates are provided with striking surfaces corresponding to conventional clubs #1 through #14. A tapered projection extends outwardly from the center of the rear surface of the face plate and a pair of smaller dowels are spaced laterally to each side of the tapered projection to be received in the bores in the recessed surface. A set screw carried in a threaded bore extending upward from the sole or bottom portion forces a small cylindrical clamping plunger into engagement with the tapered projection to secure the face plate to the club head. The club is provided as a set of two, one with the characteristics of an iron and one with the characteristics of a wood.

4 Claims, 1 Drawing Sheet

GOLF CLUB WITH HEAD HAVING EXCHANGEABLE FACE PLATES

BACKGROUND OF THE INVENTION

1. Field of the Invention

This invention relates generally to golf clubs, and more particularly to a golf club with a head having a plurality of exchangeable face plates.

2. Brief Description of the Prior Art

When playing golf, it is necessary to carry a number of clubs because each club is fashioned to provide certain characteristics to the ball when it is hit. The club chosen to hit the ball is determined by such factors as the lie of the ball, the distance from the hole, the obstacles in the flight path, wind conditions, and the amount of backspin desired. In order to have a particular club for a particular shot it is necessary for the golfer to carry a complete set of clubs or to use a cart or caddy for such purposes. It would therefore be desirable to provide fewer clubs with correspondingly less expense and less weight to carry without sacrificing the advantages of having the proper club for any shot.

Golf club heads having exchangeable face plates are known in the art. There are several patents which disclose golf club heads with exchangeable face plates of various construction.

McLaughlin, U.S. Pat. No. 1,253,700 discloses a golf club head having an exchangeable face plate and a telescoping handle and shaft which is variable in length to accord with the angle of the face plate selected. The face plate is inserted into a dovetail groove in the club head and secured by a spring latch mechanism.

Wettlaufer, U.S. Pat. No. 2,056,335 discloses a club head having an opening between its top and bottom edges and onto which a reversable inner plate and face plate are mounted by means of a wing nut. The inner plate tapers in the direction of its length and the face plate tapers in the direction of its height. The wing nut is inserted through the pivotal center of both plates. Projections on the inner and outer surface of the inner plate are received in openings in the club head and face plate to prevent accidental pivotal displacement. In use, the inner plate may be reversed to change the lateral inclination of the face plate, and/or the face plate may be reversed to change the vertical inclination. The club head weight may also be altered by weights inserted into threaded recesses in the club head.

Theibault, U.S. Pat. No. 2,211,638 discloses a golf club having an exchangeable face plate which is locked thereon by a rotatable shaft extending through the club head and having a pivotal locking lever at the side of the head.

Hill, U.S. Pat. No. 2,386,552 discloses golf club head having a recess in the face into which are clamped a plurality of relatively movable, removable wooden layers or laminations having their outer edges exposed to form the striking surface. The laminations are adjustable such that the outer edges may be disposed at any desired angle according the angle of loft desired.

Baldwin, U.S. Pat. No. 3,368,812 discloses a club head onto which an inner or receiving plate is mounted with screws. A series of exchangeable face plates each have three male "snap fit" projections which are received in female recesses in the receiving plate. The projections expand into the recesses to attach the face plate to the club head.

Maxel, U.S. Pat. No. 4,619,149 discloses a golf club head having a hollow interior with an opening onto the front face. A plurality of exchangeable face plates are mounted by screws on the front face closing off the opening.

The present invention is distinguished over the prior art in general, and these patents in particular by a golf club head having a generally rectangular recess extending inwardly a short distance from the outer surface of the face to receive a selected exchangeable face plate. A bore extends inwardly a distance from the recessed surface and a pair of smaller bores are spaced laterally to each side of the larger bore. Each face plate has a flat rear surface corresponding to the recess in the club head. A tapered projection extends outwardly from the center of the rear surface of the face plate and a pair of smaller dowels are spaced laterally to each side of the tapered projection to be received in the bores in the recessed surface. A set screw carried in a threaded bore extending upward from the sole or bottom portion forces a small cylindrical clamping plunger into engagement with the tapered projection to secure the face plate to the club head.

SUMMARY OF THE INVENTION

It is therefore an object of the present invention to provide a golf club having a head which has selectively changeable face plates to accomplish a particular shot.

It is another object of this invention to provide a golf club having a head with interchangeable face plates which may be changed easily and quickly.

Another object of this invention is to provide a golf club having a head with interchangeable face plates which may be changed easily and quickly by loosening a single screw to reduce the time required to effect the desired club characteristics.

Another object of this invention is to provide a golf club having a head with interchangeable face plates wherein the face plates are secured firmly and safely onto the club head to prevent accidental dislodging during play.

A further object of this invention is to provide a golf club having a head with interchangeable face plates allowing the golfer to play a round of golf with fewer clubs and less weight to carry without sacrificing the advantages of having the proper club for a particular shot.

A still further object of this invention is to provide a golf club having a head with interchangeable face plates which is simple in construction, economical to manufacture, and rugged and durable in use.

Other objects of the invention will become apparent from time to time throughout the specification and claims as hereinafter related.

The above noted objects and other objects of the invention are accomplished by a golf club head having a selection of exchangeable face plates adapted to be secured thereon. The club head has a generally rectangular recess extending inwardly a short distance from the outer surface of the face to receive the exchangeable face plate. A bore extends inwardly a distance from the recessed surface and a pair of smaller bores are spaced laterally to each side of the larger bore. Each face plate has a flat rear surface corresponding to the recess in the club head. The face plates are provided in varied swing weights and hardnesses and the ball striking surfaces have different characteristics for loft, bulge, and or roll. A plurality of face plate provide striking surfaces corresponding to conventional manufactured clubs #1 through #14. A tapered projection extends outwardly from the center of the rear surface of the face plate and a pair of smaller dowels are spaced laterally to each side of the tapered projection to be received in the bores in the recessed surface. A set screw carried in a threaded bore extending upward from the sole or bottom portion forces a small cylindrical clamping plunger into engagement with the tapered projection to secure the face plate to the club head.

DESCRIPTION OF THE PREFERRED EMBODIMENT

Figure 1:
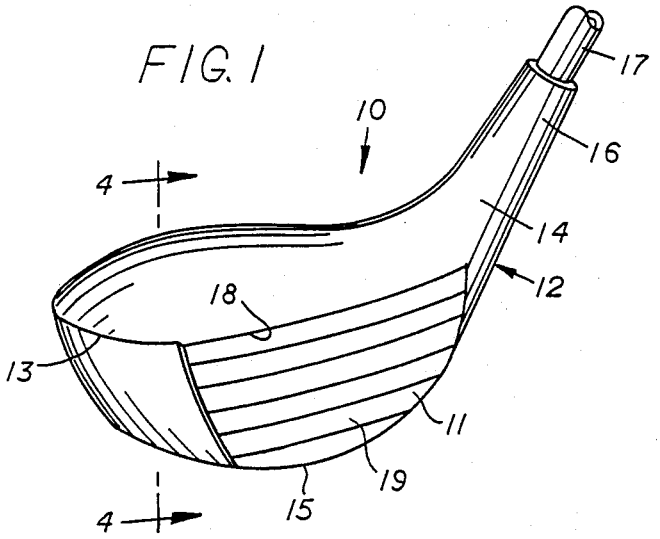
FIG. 1 is a perspective view of a golf club head having exchangeable face plates in accordance with the present invention.

Referring to the drawings by numerals of reference, there is shown in FIG. 1, a preferred golf club head 10 having one of a plurality of exchangeable face plates 11 secured thereon. The club head 10 includes a face 12, a toe portion 13, a heel portion 14, a sole or bottom portion 15, and a hosel 16 in the form of a tubular extension which receives a shaft 17. The club head 10 is of wood or plastic. A generally rectangular recess 18 extends inwardly a short distance from the outer surface of the face 12 to receive the exchangeable face plate 11.

Figure 4:
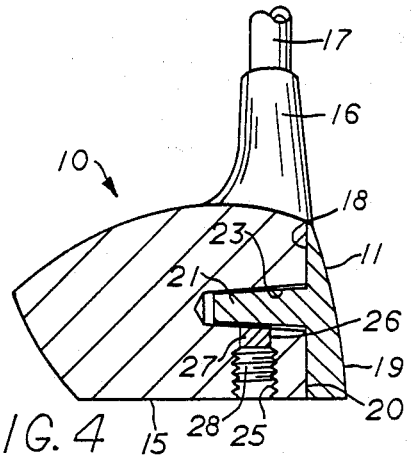
FIG. 4 is a partial cross section of the golf club head taken along lines 4—4 of FIG. 1 showing the attachment details of the exchangeable face plate.
Figure 3:
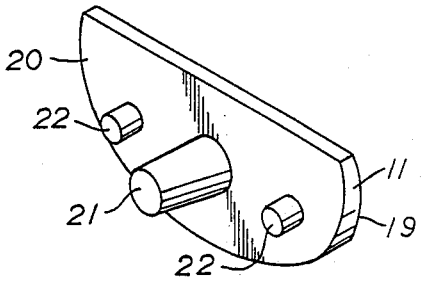
FIG. 3 is a perspective view showing the rear surface of a preferred exchangeable face plate.
Figure 2:
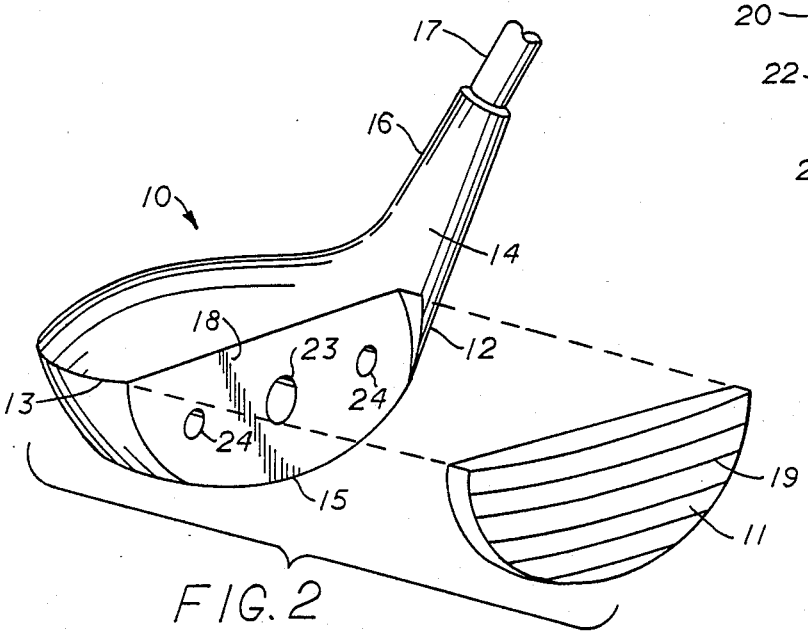
FIG. 2 is an exploded perspective view of a golf club head having exchangeable face plates with the face plate removed therefrom.

As best seen in FIGS. 2, 3, and 4, the face plate 11 comprises a generally rectangular plate corresponding to the recess 18 in club head 10. The face plates 11 may be formed of any suitable material to provide varied swing weights and varied hardnesses to the front or ball striking surface 19. The striking surface 9 of the face plates 11 are also horizontally scored to create top spin on the golf ball. The rear surface 20 of each face plate 11 is flat.

Figure 5:
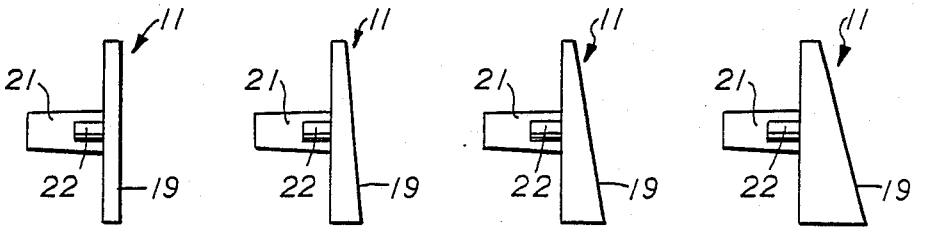
FIG. 5 is a side elevation view of a plurality of exchangeable face plates.

As shown in FIG. 5, a plurality of face plates 11 are provided with the club head and the striking surface 19 of each is configured to have different specifications for loft, bulge, and or roll. A preferred plurality of such face plates would provide striking surfaces corresponding to conventional manufactured clubs #1 through #14. The clubs will usually be provided in a set of two, one having the weight and balance of an iron and the other having the weight and balance of a wood.

A tapered projection 21 extends outwardly from the center of the rear surface 20 of face plate 11 with the outer end being the smaller diameter. The drawings show the taper of the projection somewhat exagerated for purposes of clarity. A pair of smaller rod-like dowels 22 extend outwardly from the rear surface 20, one spaced laterally to each side of the tapered projection 21.

A tapered bore 23 extends inwardly a distance from the recessed surface 18 of the face 12 of club head 10, and a pair of smaller bores 24 extend inwardly from the recessed surface 18, one spaced laterally to each side of the bore 23 corresponding axially to the spacing of the projection 21 and dowels 22 of the face plate 11.

A threaded bore 25 extends vertically upward from the sole or bottom portion 15 of the club head and terminates in a small bore 26. A small cylindrical clamping plunger 27 is slidably received in the small bore 26. A set screw 28 is threadedly received in the threaded bore 25.

To attach a selected face plate 11 to club head 10, the face plate is positioned at the face of the club with projection 21 in axial alignment with bore 23. The projection 21 is pushed into the 23 and dowels 22 enter bores 24. The clearance between bore 23 and tapered projection 21 is exaggerated; there is actually a fairly close fit. The set screw 28 is then tightened to force clamping plunger 27 into engagement with projection 21 and the face plate is secured to the club head. To remove the face plate and replace it with another, the process is reversed. The taper of projection 21 facilitates reinsertion into bore 23 past plunger 27.

While this invention has been described fully and completely with special emphasis upon a preferred embodiment, it should be understood that within the scope of the appended claims the invention may be practiced otherwise than as specifically described herein.

I claim:

1. A golf club head having exchangeable face plates comprising;

a body having a face portion, a toe portion, a heel portion, a sole portion, and a hosel portion, a recessed surface formed on said face portion having a plurality of bores extending inwardly a distance into the body, a plurality of face plates removably securable on said recessed surface and having respective face plate striking surfaces configured to impart predetermined flight characteristics to the ball corresponding to clubs ranging from U.S.G.A. #1 through #14, each said face plate having a flat rear surface with a plurality of projections extending outwardly therefrom to be received in said bores and a front ball striking surface which is configured to impart predetermined flight characteristics to the ball when struck thereby, said one or more bores in said recessed surface comprising a central tapered bore and a pair of second bores, one spaced laterally to each side of the first bore extending inwardly from said recessed surface to receive said projections, said one or more projections on said face plate rear surface comprise a tapered projection extending outwardly from the center of the rear surface of said face plate and a pair of smaller dowels extending outwardly from the rear surface, one spaced laterally to each side of the tapered projection and corresponding axially to the spacing of said bores, and means for securing removably and replaceably said face plate non-rotatably on said body face portion extending from said body sole portion and releaseably engaging said tapered projection to secure said face plate on said recessed surface, and comprising a set screw threadedly received in a threaded bore extending from the sole portion of said body and at a right angle to and operatively engaging said tapered projection of said face plate and a clamping member comprising a small cylindrical plunger slidably received in the threaded bore and moved into engagement with said tapered projection by said set screw, the taper on said projection being effective to move said plunger back into said threaded bore on insertion into said tapered bore.

2. A golf club head according to claim 1 in which the head body portion and face plate have the characteristics of an iron.

3. A golf club head according to claim 1 in which the head body portion and face plate have the characteristics of a wood.

4. A set of golf clubs comprising a pair of clubs as defined in claim 1, in which one club has a head and a plurality of exchangeable face plates having the characteristics of an iron, and the other club has a head and a plurality of exchangeable face plates having the characteristics of a wood.

* * * * *